US007007498B2

(12) United States Patent
Hansen

(10) Patent No.: US 7,007,498 B2
(45) Date of Patent: Mar. 7, 2006

(54) HVAC CABINET WITH CONFIGURABLE DUCT CONNECTIONS

(75) Inventor: William G. Hansen, Adams, TN (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/692,615

(22) Filed: Oct. 24, 2003

(65) Prior Publication Data

US 2005/0086972 A1 Apr. 28, 2005

(51) Int. Cl.

| | |
|---|---|
| ***F25D 19/00*** | (2006.01) |
| ***F25D 17/06*** | (2006.01) |
| ***F24F 7/007*** | (2006.01) |
| ***F24F 7/06*** | (2006.01) |

(52) U.S. Cl. ..... 62/298; 62/412; 62/426; 454/234; 454/235

(58) Field of Classification Search ..... 454/235, 454/234, 233, 236, 249; 62/410, 412, 414, 62/419, 426, 298

See application file for complete search history.

(56) References Cited

U.S. PATENT DOCUMENTS

| | | | | |
|---|---|---|---|---|
| 2,310,843 | A * | 2/1943 | Ditzler | 62/426 |
| 3,020,820 | A * | 2/1962 | Hopkinson et al. | 454/233 |
| 3,089,315 | A * | 5/1963 | Brandt | 62/326 |
| 3,174,541 | A * | 3/1965 | Brandt et al. | 165/122 |
| 4,098,093 | A * | 7/1978 | Czyl | 62/243 |
| 4,747,505 | A * | 5/1988 | Hansen | 220/4.28 |
| 4,851,162 | A * | 7/1989 | Sperr et al. | 261/105 |
| 5,029,452 | A * | 7/1991 | Mourabet et al. | 62/298 |
| 5,309,892 | A | 5/1994 | Lawlor | |
| 5,376,045 | A * | 12/1994 | Kiser | 454/229 |
| 5,444,990 | A * | 8/1995 | McGill et al. | 62/298 |
| 5,728,973 | A * | 3/1998 | Jorgensen | 174/65 R |
| 5,749,355 | A * | 5/1998 | Roan et al. | 126/110 R |
| 6,067,227 | A * | 5/2000 | Katsui et al. | 361/695 |
| 6,260,374 | B1 * | 7/2001 | Smith et al. | 62/298 |
| 6,457,653 | B1 * | 10/2002 | Campbell | 236/49.3 |
| 6,623,353 | B1 * | 9/2003 | Akhtar et al. | 454/233 |

* cited by examiner

*Primary Examiner*—William C. Doerrler
(74) *Attorney, Agent, or Firm*—William J. Beres; William O'Driscoll

(57) ABSTRACT

A cabinet for air handling equipment includes two similarly sized covers that are each nonsymmetrical about their vertical centerline. Each cover has an original supply or return air duct opening plus space for an alternate opening. The original and alternate openings are of different shapes to accommodate round or rectangular ducts. The two covers can be interchanged with each other and inverted to provide various supply and return air duct configurations.

16 Claims, 3 Drawing Sheets

HVAC CABINET WITH CONFIGURABLE DUCT CONNECTIONS

BACKGROUND OF THE INVENTION

1. Field of the Invention

The present invention relates to a cabinet for heating, ventilating, and air conditioning equipment and more specifically relates to a cover panel with configurable duct connections.

2. Description of Related Art

An air handler is any apparatus comprising an enclosure that contains at least one piece of air handling equipment, such as a blower, heat exchanger, compressor, filter, etc. Air handlers typically provide conditioned air to a comfort zone, such as a room or other designated area within a building. The conditioning of the air may include, but is not limited to, heating, cooling, humidifying, dehumidifying, filtering, ventilating, and various combinations thereof.

Air handlers can assume a wide variety of configurations with one example being a direct expansion refrigerant system. A direct expansion refrigerant system typically comprises a refrigerant circuit that includes a compressor, a condenser, an expansion device and an evaporator. The equipment plus a blower is normally housed within an outdoor cabinet that is installed atop or adjacent to a building served by the air handler.

To heat or cool the building, the blower forces air across the condenser or evaporator, and supply and return air ducts convey the air between the building and the air handler. The supply air duct conveys the conditioned air to the building, while the return air duct conveys used air from the building to the air handler.

The cross-sectional shape of the ducts (e.g., round or rectangular) and the layout of the ductwork are usually dictated by the design of each particular air handler and various features of the building. Problems can occur when after years of use the originally installed air handler needs to be replaced. The replacement system may require ductwork of a different shape and layout. Thus, various duct adaptors and convoluted transitional ductwork may be needed to connect a replacement air handler to a building's existing ductwork. This may reduce airflow through the ducts and create an unsightly installation.

Problems may also occur with new installations where ductwork must connect a certain air handler to a particular building. In some cases, "spec homes" may be built complete with ductwork but without the air handler. This allows the new homeowner to specify their preferred air handler. The chosen air handler, however, may not necessarily match the home's pre-installed ductwork. In other cases, the home or building may have immovable structural members that inhibit certain duct configurations.

Consequently, a need exists for a system or method of connecting an air handler (e.g., a replacement unit or an original installation) to a building's existing ductwork.

SUMMARY OF THE INVENTION

To overcome the problems of connecting an air handler to a building's ductwork, it is an object of some embodiments of the invention to provide a cabinet for air handling equipment, wherein a supply air opening and a return air opening are in separate cover panels that can be inverted and interchanged to vary the relative location of the two openings.

Another object of some embodiments is to provide an air handler whose air duct openings can be placed closer to each other or spaced farther apart. Being closer together may allow the supply and return air ducts to fit through the same narrow opening in the wall or foundation of a building, and being farther apart may allow the ducts to straddle a generally immovable structural member of the building.

Another object of some embodiments is to provide an air handler whose supply and return air duct openings can be placed vertically offset to each other with either opening being selectively placed higher than the other. This may simplify the transitional ductwork needed to connect to a building with vertically offset ducts (i.e., over/under configurations), regardless of whether the building's supply air duct is above the return air duct or vice versa.

Another object of some embodiments is to provide an air handler whose supply and return air duct openings can be positioned both vertically and horizontally offset to each other. This may simplify crossover ductwork that may be needed to connect the air handler to a building whose supply and return air ducts are horizontally displaced in a direction opposite that of the air handler's air duct openings. In other words, it is an object of some embodiments to simplify the installation when the supply air and return air ducts in the building are opposite from the supply and return air duct connections in the unit.

Another object of some embodiments is to provide a cover panel for a cabinet, wherein the cover includes a rectangular opening and a round opening (or an area therefore), so that the cabinet can be connected to either round or rectangular ductwork.

Another object of some embodiments is to provide a cabinet cover with a rectangular opening and an optional round opening, wherein the two openings are located one above the other.

Another object of some embodiments is to provide a cabinet cover with a rectangular opening and an optional round opening, wherein the two openings are horizontally displaced relative to a vertical centerline of the cover, whereby inverting the panel shifts the location of the openings to either side of the centerline.

Another object of some embodiments is enable a cabinet panel to be reconfigured even though the interior side of the panel is thermally insulated.

One or more of these and/or other objects of the invention are provided by a cabinet for air handling equipment, wherein the cabinet includes two similarly sized covers that are each nonsymmetrical about their vertical centerline. The two covers can be interchanged and inverted to provide various supply and return air duct configurations.

DESCRIPTION OF THE PREFERRED EMBODIMENT

Figure 1:
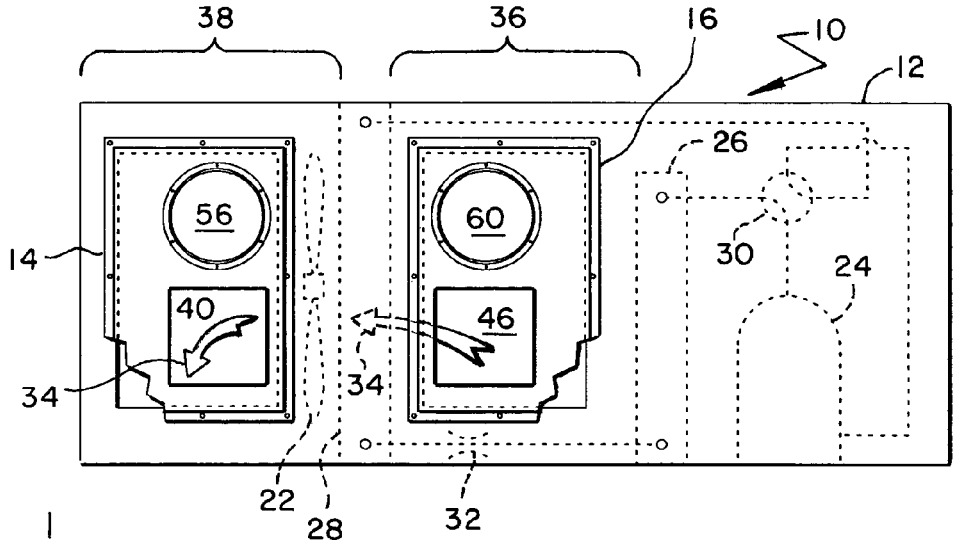
FIG. 1 is a front view of an air handler with two covers shown installed in one of many configurations.

Referring to FIGS. 1—5, an air handler 10 comprises various air handling equipment contained within an enclosure. The enclosure itself comprises a cabinet 12 with a first cover 14 (cover-A) and a second cover 16 (cover-B). Covers 14 and 16 have one or more air duct openings that enable ductwork 18 to connect cabinet 12 to an adjacent building 20. The two covers 14 and 16 are invertible and interchangeable to accommodate various ductwork configurations.

The air handling equipment housed within cabinet 12 can vary greatly, so the air handler illustrated in FIG. 1 simply serves as one example. In this particular example, the equipment in cabinet 12 includes a blower 22, a compressor 24, a first heat exchanger 26, a second heat exchanger 28, a two-position, four-way valve 30, and an expansion device 32 (e.g., expansion valve, orifice, capillary, etc.).

With valve 32 in the cooling mode position shown in FIG. 1, compressor 24 forces refrigerant sequentially through valve 30, heat exchanger 26 (functioning as a condenser: air or water cooled), expansion device 32, heat exchanger 28 (functioning as an evaporator), and back through valve 30 to return to a suction inlet of compressor 24. Within cabinet 12, blower 22 moves air 34 from a suction chamber 36 to a discharge chamber 38 by forcing the air through heat exchanger 28, which operates as an evaporator to cool air 34.

Blower 22 forces the cooled air 34 out through an opening 40 (opening-A) in cover 14, and a supply air duct 42 conveys the air to building 20. After cooling building 20, the air returns to cabinet 12 via a return air duct 44. Return duct 44 returns the air back to suction chamber 36 by directing air 34 through an opening 46 (opening-B) in cover 16.

Air handler 10 can be a cooling-only system, or in some cases valve 30 or other means can be used to selectively place air handler 10 in a heating mode. For example, valve 30 can reverse the flow of refrigerant so that heat exchanger 28 functions as a condenser for providing building 20 with heated air, whereby heat exchanger 26 would then function as an evaporator.

Figure 3:
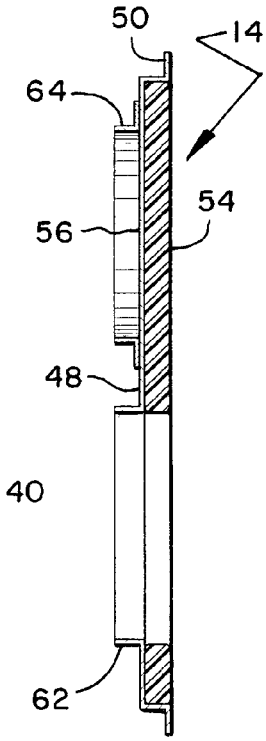
FIG. 3 is a cross-sectional view taken along line 3—3 of FIG. 2.
Figure 2:
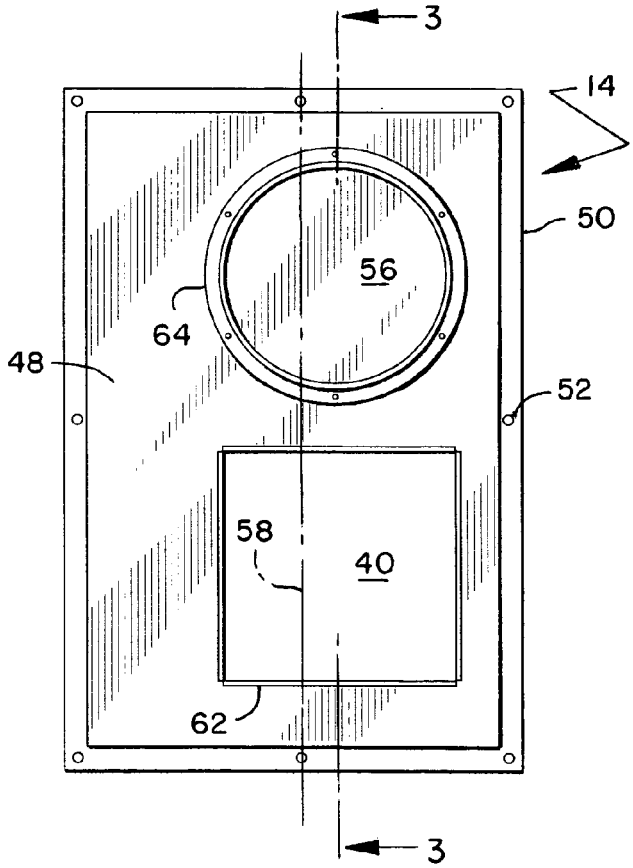
FIG. 2 is a front view of a cabinet cover.

The actual construction of covers 14 and 16 may vary. In FIGS. 2 and 3, for example, cover 14 is a generally rectangular sheet metal panel 48 having a peripheral flange 50 with screw holes 52 for attaching cover 14 to cabinet 12. The actual design of flange 50 may vary. Flange 50 may extend outward and parallel to panel 48 as shown, extend inward and parallel to panel 48, extend along a plane that is perpendicular to panel 48, or extend in a combination of directions. An interior side of cover 14 may include a sheet of thermal insulation 54. Cover 14 includes opening 40 and an alternate area 56 (alternate area-A) that are set one above the other and are offset to a vertical centerline 58 of cover 14.

Cover 16 is a mirror image of cover 14 with cover 16 having opening 46 and an alternate area 60 (alternate area-B) that are set one above the other and are offset to a vertical centerline 62 of cover 16. Openings 40 and 46 are rectangular openings surrounded by a flange 62 for connection to rectangular ducts.

Alternate areas 56 and 60 provide space for connecting round ductwork in case the existing ductwork of building 20 happens to be round. A round flange 64 can be used to connect a round duct to cover 14. If round ductwork is used, the portion of cover 14 or 16 that is within flange 64 would need to be cut out or otherwise removed, and opening 40 or 46 would need to be blocked off.

Figure 4:
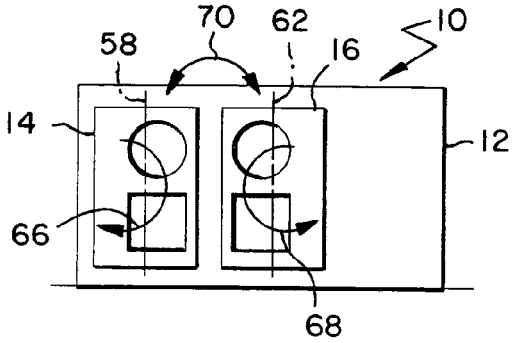
FIG. 4 is similar to FIG. 1.
Figure 5:
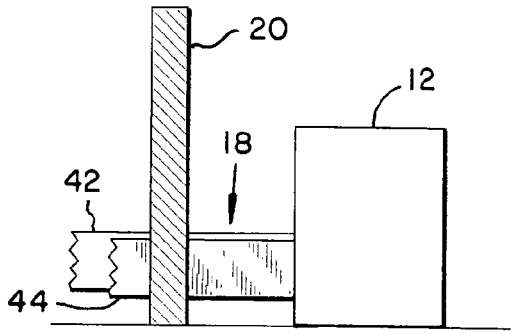
FIG. 5 is a side view of the air handler of FIG. 4 showing rectangular ducts connected to the air handler.

Covers 14 and 16 can be attached to cabinet 12 in various arrangements to accommodate various ductwork configurations. In FIGS. 4 and 5, for example, rectangular ducts 42 and 44 are low and relatively close to each other. Arrows 66, 68 and 70 represent one or more steps in the process of reconfiguring the covers. These steps may include removing a cover, inverting a cover, inverting a cover, reattaching a cover, interchanging the covers, etc.

Figure 6:
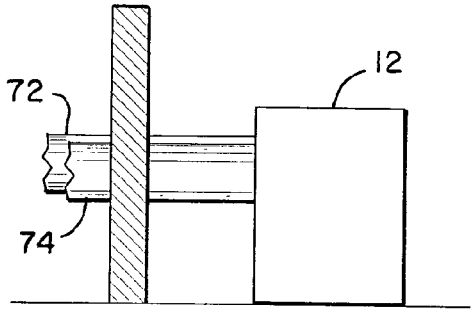
FIG. 6 is similar to FIG. 5 but showing round ducts connected to the air handler.

In FIG. 6, covers 14 and 16 are in the same positions as shown in FIG. 4; however, round ducts 72 and 74 connect to flanges 64, and openings 40 and 46 are blocked off. In this configuration, round ducts 72 and 74 replace rectangular ducts 42 and 44 respectively.

Figure 7:
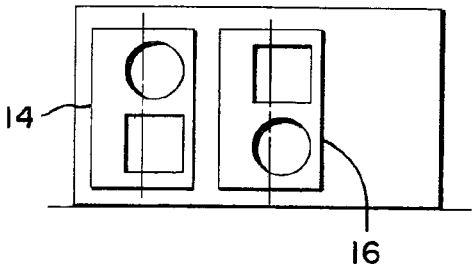
FIG. 7 is similar to FIG. 4 but with the right-hand cover inverted.
Figure 8:
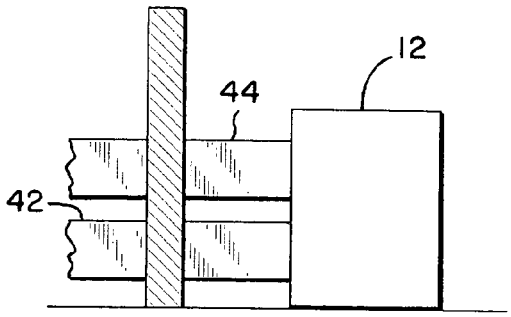
FIG. 8 is a side view of FIG. 7.

The configuration shown in FIGS. 7 and 8 is similar to that of FIGS. 4 and 5; however, cover 16 is inverted to raise the elevation of duct 44 and provide greater horizontal spacing between ducts 42 and 44.

Figure 9:
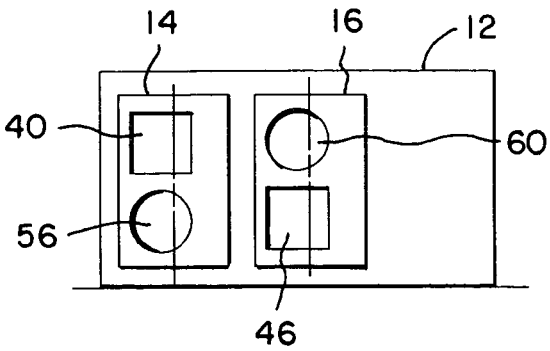
FIG. 9 is similar to FIG. 4 but with the left-hand cover inverted.

The configuration shown in FIG. 9 is similar to that of FIG. 4; however, cover 14 is inverted to raise the elevation of opening 40 (or lower alternate area 56) and provide greater horizontal spacing between openings 40 and 46 (or increase the spacing between alternate areas 56 and 60).

Figure 10:
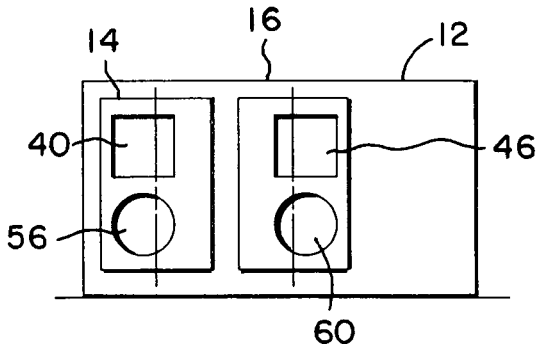
FIG. 10 is similar to FIG. 4 but with both covers inverted.

The configuration shown in FIG. 10 is similar to that of FIG. 4; however, both covers 14 and 16 are inverted to raise the elevation of both openings 40 and 46 (or lower areas 56 and 60) and provide greater horizontal spacing between them.

Figure 11:
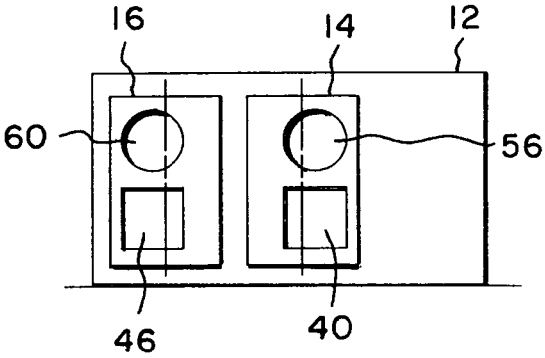
FIG. 11 is similar to FIG. 4 but with the two cover interchanged with each other.

The configuration shown in FIG. 11 is similar to that of FIG. 4; however, the two covers 14 and 16 are interchanged to increase the spacing not only between openings 40 and 46 but also between alternate areas 56 and 60.

Figure 12:
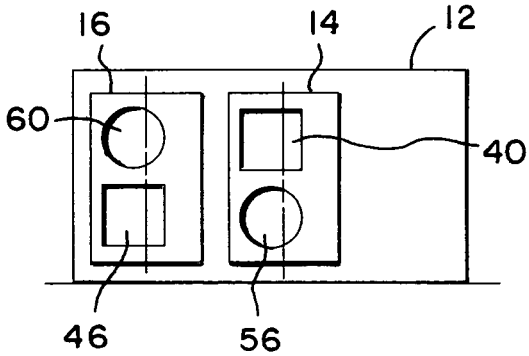
FIG. 12 is similar to FIG. 11 but with the right-hand cover inverted.

The configuration shown in FIG. 12 is similar to that of FIG. 11; however, cover 14 is inverted to raise the elevation of opening 40 (or lower area 56) and to decrease the horizontal spacing between openings 40 and 46.

Figure 13:
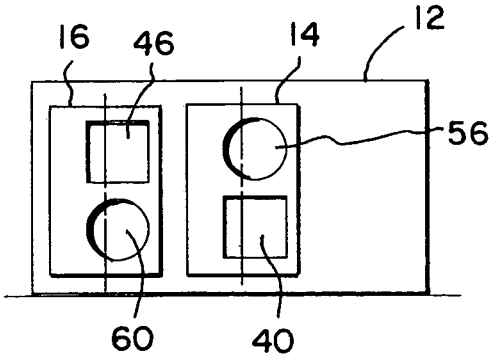
FIG. 13 is similar to FIG. 11 but with the left-hand cover inverted.

The configuration shown in FIG. 13 is similar to that of FIG. 11; however, cover 16 is inverted to raise the elevation of opening 46 (or lower area 60) and to decrease the horizontal spacing between openings 40 and 46.

Figure 14:
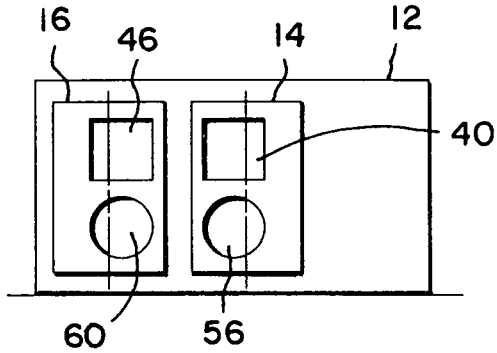
FIG. 14 is similar to FIG. 11, but with both covers inverted.

The configuration shown in FIG. 14 is similar to that of FIG. 11; however, both covers 14 and 16 are inverted to raise the elevation of both openings 40 and 46 (or lower areas 56 and 60) and provide less horizontal spacing between them.

Although the invention is described with reference to a preferred embodiment, it should be appreciated by those skilled in the art that other variations are well within the scope of the invention. Therefore, the scope of the invention is to be determined by reference to the claims, which follow.

I claim:

1. An enclosure for air handling equipment, comprising:

a cabinet defining a supply air outlet and a return air inlet, wherein the supply air outlet and the return air inlet are substantially equal in size and shape;

a cover-A overlaying the supply air outlet and being generally rectangular with a centerline-A;

a cover-B overlaying the return air inlet and being generally rectangular with a centerline-B;

wherein the cover-A defines an opening-A and an alternate area-A both of which overlay the supply air outlet and are offset relative to the centerline-A;

wherein the cover-B defines an opening-B and an alternate area-B both of which overlay the return air inlet and are offset relative to the centerline-B;

wherein the cover-A and the cover-B are interchangeable with each other and are each invertible to vary the relative positions of the opening-A, opening-B, alternate area-A and alternate area-B.

2. The enclosure of claim 1, wherein the opening-A and the opening-B are substantially rectangular.

3. The enclosure of claim 1, wherein the supply air outlet and the return air inlet have a vertical orientation and the opening-A and the alternate area-A are vertically offset to each other.

4. The enclosure of claim 1, further comprising thermal insulation disposed on one side of the cover-A.

5. The enclosure of claim 1, further comprising a round flange extending from the alternate opening-A.

6. The enclosure of claim 1, wherein the supply air outlet and the return air inlet have a vertical orientation and the centerline-A is substantially vertical.

7. The enclosure of claim 1, wherein the cover-A is adjacent to cover-B.

8. An air handler for a building, comprising:

a cabinet disposed outside the building and defining a supply air outlet and a return air inlet, wherein the supply air outlet and the return air inlet are substantially equal in size and shape;

a compressor inside the cabinet;

a condenser inside the cabinet;

an expansion device coupled to the condenser;

an evaporator inside the cabinet and connected to the compressor, the condenser, and the expansion device to provide a closed loop refrigeration circuit;

a blower inside the cabinet and forcing air from the return air inlet to the supply air outlet and across at least one of the condenser and the evaporator;

a cover-A overlaying the supply air outlet and being generally rectangular with a centerline-A, wherein the cover-A defines an opening-A and an alternate area-A both of which overlay the supply air outlet and are offset relative to the centerline-A;

a cover-B overlaying the return air inlet and being generally rectangular with a centerline-B, wherein the cover-B defines an opening-B and an alternate area-B both of which overlay the return air inlet and are offset relative to the centerline-B, wherein the cover-A and the cover-B are interchangeable with each other and are each invertible to vary the relative positions of the opening-A, opening-B, alternate area-A and alternate area-B;

a supply air duct extending from the cover-A to the building; and a return air duct extending from the cover-B to the building.

9. The air- handler of claim 8, wherein the opening-A and the opening-B are substantially rectangular.

10. The air handler of claim 8, wherein the supply air outlet and the return air inlet are vertically oriented and the opening-A and the alternate area-A are vertically offset to each other.

11. The air handler of claim 8, further comprising thermal insulation disposed on one side of the cover-A.

12. The air handler of claim 8, further comprising a round flange extending from the alternate opening-A.

13. The air handler of claim 8, wherein the supply air outlet and the return air inlet are vertically oriented and the centerline-A is substantially vertical.

14. The air handler of claim 8, wherein the cover-A is adjacent to cover-B.

15. A method of configuring an enclosure for air handling equipment, wherein the enclosure includes a cover-A that defines a opening-A leading to a supply air outlet of the enclosure and a cover-B that defines an opening-B leading to a return air inlet of the enclosure, the method comprising:

removing the cover-A and the cover-B from the enclosure;

swapping the positions of the cover-A and the cover-B; and reattaching the cover-A and the cover-B to the enclosure, thereby changing a distance between the opening-A and the opening-B.

16. The method of claim 15, further comprising inverting at least one of the cover-A and the cover-B.

* * * * *